United States Patent [19]

Miyamoto

[11] Patent Number: 4,799,407

[45] Date of Patent: Jan. 24, 1989

[54] RATCHET SCREWDRIVER

[75] Inventor: Yoshikazu Miyamoto, Higashiosaka, Japan

[73] Assignee: Rubicon Co., Ltd., Osaka, Japan

[21] Appl. No.: 79,533

[22] Filed: Jul. 30, 1987

[30] Foreign Application Priority Data

Aug. 26, 1986 [JP] Japan ..... 61-200343

[51] Int. Cl.[4] ..... B25B 13/46

[52] U.S. Cl. ..... 81/58.3; 81/58.1; 81/63.2

[58] Field of Search ..... 81/58.1, 58.3, 58.4, 81/60, 63.1, 63.2, 177.2

[56] References Cited

U.S. PATENT DOCUMENTS 2,641,291 6/1953 Yess ..... 81/58.3 X
2,989,881 6/1961 Lavietes ..... 81/63.2
3,272,246 9/1966 Bohnet ..... 81/58.3 X
3,799,226 3/1974 Lavietes ..... 81/63.2
4,235,269 11/1980 Kraus ..... 81/60 X

*Primary Examiner*—Debra Meislin
*Attorney, Agent, or Firm*—Jones, Tullar & Cooper

[57] ABSTRACT

A ratchet screwdriver comprising a bit attaching section, an operating section body which turns the bit attaching section in one direction only, a handle section which is connected to the operating section body on a turning axis, and an auxiliary handle which is inserted into the operating section body for turning control of the screwdriver, and in which the handle section is freely rotatable in relation to the operating section body when the auxiliary handle is inserted into the operating section body and operated.

5 Claims, 4 Drawing Sheets

RATCHET SCREWDRIVER

BACKGROUND OF THE INVENTION

1. Field of the Invention

The present invention relates to a ratchet screwdriver in which a bit attaching section and a turning operation section are connected to each other through a ratchet mechanism so as to drive and loosen a screw by repeating operations for applying torque to the screwdriver in one direction.

2. Prior Art

Generally, a ratchet driver is very easy to handle, as compared with conventional screwdrivers comprising a bit fixed to a handle, since the ratchet screwdriver can be operated just by repeating operations for applying torque in one direction only.

There is, however, an increasing trend demanding a ratchet screwdriver capable of turning a screw with stronger torque and carrying out exact screwing and loosening operations under the background of diversified kinds of works.

In known ratchet screwdrivers, the turning operation section and the bit attaching section are coaxially coupled, and the turning operation section is formed into an integral one section. Accordingly, in such a conventional ratchet screwdriver, the turning operation section coaxially coupled with the bit attaching section needs to be operated directly and exclusively with its handle part. Thus, it is impossible to drive and loosen a screw strongly with high power since there is a limit in the torque produced by such a conventional ratchet screwdriver.

In order to meet the aforesaid increasing demand, a ratchet screwdriver was recently disclosed in Japanese Laid-Open Patent Publication (unexamined) No. 59-227369, and in this ratchet screwdriver, the turning operation section is divided into an operating section body serving as a connecting section with the bit attaching section and a handle section which is connected to the operating section body, and the handle section is rotatable in the direction where the axis of the handle section intersects that of the operating section body.

According to the disclosed ratchet screwdriver, a relatively strong torque can indeed be obtained by utilizing lever action. But a serious problem exists in that it is quite difficult to apply a force in the axial direction of the bit, since the handle section is in the direction perpendicular to the axial direction of the bit allowing only one-handed manual operation, eventually resulting in insufficient use of the increased torque. In other words, exact operation cannot be carried out by turning such a handle section.

SUMMARY OF THE INVENTION

The present invention was made to solve the above-discussed problem and has an object of providing a ratchet screwdriver capable of obtaining strong torque with ease.

To accomplish the foregoing object, a ratchet screwdriver according to the present invention comprises a bit attaching section, an operating section body which is connected to the bit attaching section through a ratchet mechanism and capable of turning the bit attaching section around the axis of the bit only in one direction, a handle section which is connected to the operating section body on the turning axis, a locking mechanism connecting the operating section body to said handle section, and which engages the handle section with the operating section body under normal state so as to turn these two sections together, the two sections being freely turnable in relation to each other keeping their connected state when disengaged, and an auxiliary handle which disengages the operating section body from the handle section, engaged by the locking mechanism under normal state, by being inserted from a side of the operating section body thereinto.

According to the ratchet screwdriver of the above construction, since the operating section body can be turned by the auxiliary handle which is inserted into the operating section body, the auxiliary handle serves as a lever (in the action of levers), thereby enabling the driving and loosening operations with stronger torque.

Furthermore, when inserting the auxiliary handle into the operating section body, since the handle section is turnable in relation to the operating section body while keeping the connection between the handle section and the operating body section, safe and exact screwing operation can be performed using both hands by supporting the handle section with one hand while the other hand is operating the auxiliary handle.

Other objects and features of the invention will become apparent in the course of the following description with the accompanying drawings.

DETAILED DESCRIPTION OF THE PREFERRED EMBODIMENT

Figure 1:
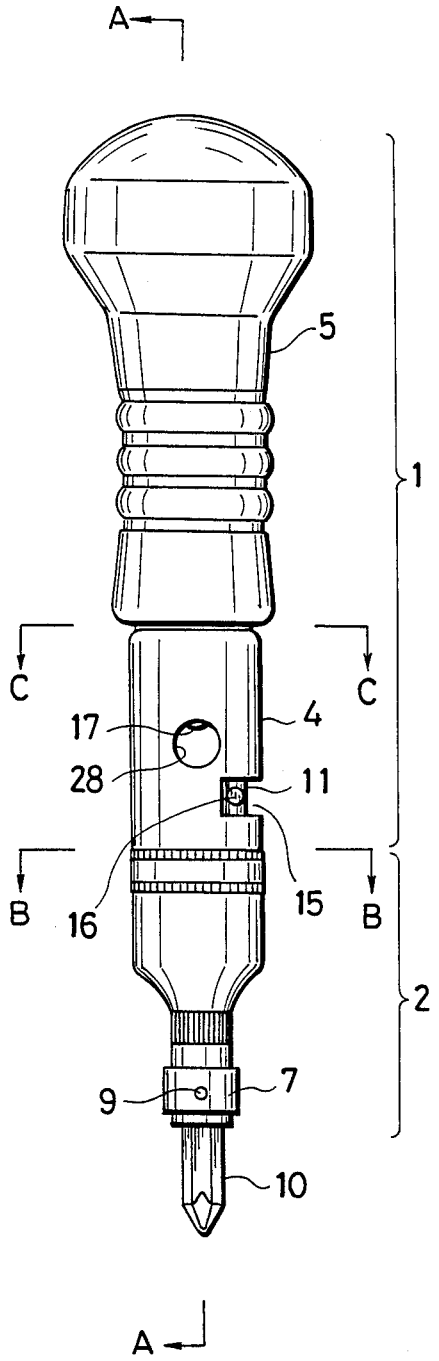
FIG. 1 is a front view showing an embodiment of the present invention.
Figure 2:
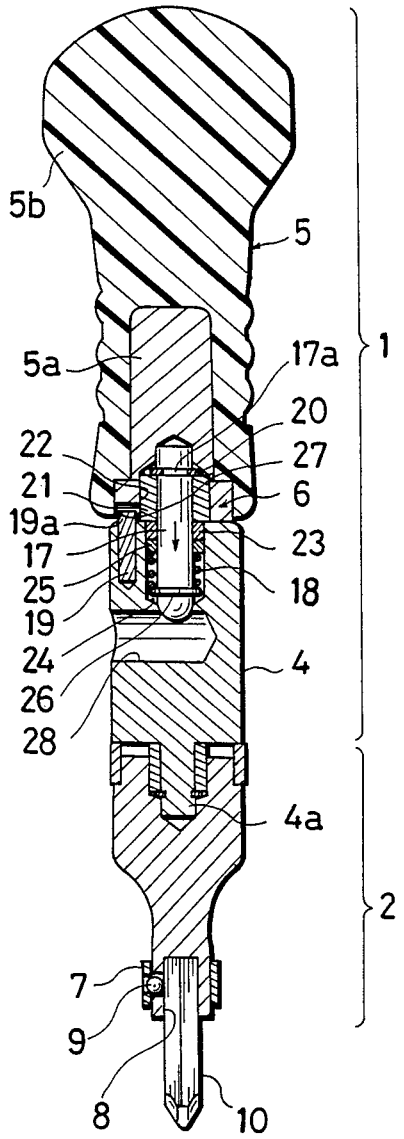
FIG. 2 is a sectional view taken along the line A—A in FIG. 1.
Figure 3:
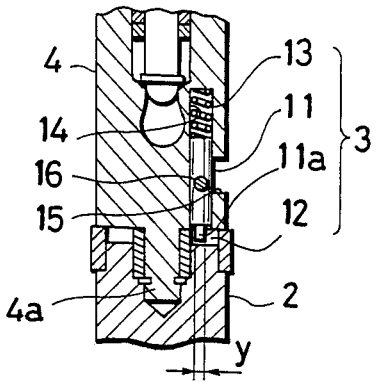
FIG. 3 is a partially longitudinal sectional view showing the ratchet mechanism.

In the embodiment shown in FIG. 1 and FIG. 2, a turning operation section 1 is connected to a bit attaching section 2 through a ratchet mechanism 3 shown in FIG. 3 so as to be turnable in one direction only.

The turning operation section 1 comprises an operating section body 4 which is connected to the bit attaching section 2 and a handle section 5 which is connected to the operating section body 4 on the turning axis through a locking mechanism 6. The handle section 5 comprises a metallic core **5*a* and an external handle member 5*b*, and a turning shaft 4*a* is provided in the operating section body 4 so as to be inserted in the bit attaching section 2** coaxially with the bit.

Provided at the top end of the bit attaching section 2 is an annular tightening member 7 which is mounted on the outer periphery of the top end portion, and a spheroidal member 9 which is pressed in the bit receiving hole 8 side by compressive force of the tightening member 7. The bit 10 inserted in the receiving hole 8 is tightly fitted into the receiving hole 8 due to the pressing force of the spheroidal member 9. Accordingly, the bit 10 can be easily set into the hole 8 and taken out therefrom, and it is possible to freely and easily replace the plus bit shown in the drawing with other bits used for minus thread or box-type bits.

Figure 4:
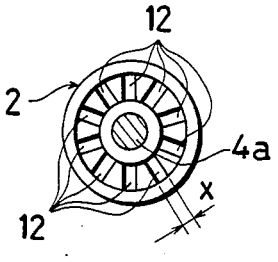
FIG. 4 is a sectional view taken along the line B—B in FIG. 1.
Figure 5A:
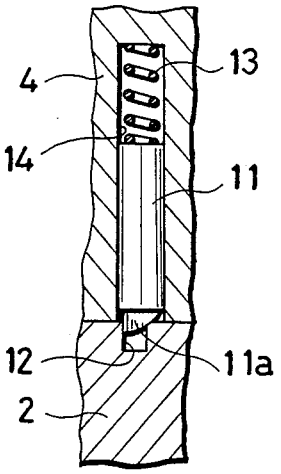
FIG. 5 A and FIG. 5 B are sectional views for explaining the actuation of ratchets.
Figure 5B:
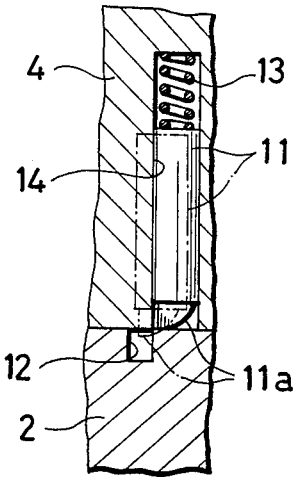

The ratchet mechanism 3 comprises a ratchet member 11, grooves 12 with which a ratchet 11*a* formed on the top end of the ratchet member 11 engages, and a compression spring 13 which gives impetus to said ratchet member 11 against the groove 12 side. In this way, the ratchet member 11 is inserted in the guide hole 14 for sliding provided on the connection surface between the operating section body 4 and the bit attaching section 2, and the impetus is given to the ratchet member 11 by the compression spring 13, which is provided between the bottom of the guide hole 14 and the ratchet member 11, so that the ratchet 11*a* projects from the surface of the operating section 4. The ratchet 11*a* is formed into a triangular shape with its one side inclined while the other side is vertical as shown in FIG. 5A and FIG. 5B when looking from the side thereof. As shown in FIG. 4, a plurality of grooves 12 are radially formed around the turning shaft 4*a* on the connection surface between the bit attaching section 2 and the body section 4. The width x of each groove 12 is established smaller than the width y (see FIG. 3) of the ratchet 11*a* of the ratchet member 11 in the groove 12. Accordingly, when the top end of the ratchet 11*a* gets in the groove 12 by the urging force of the spring 13, the triangular surface always faces the outer periphery side. When the operating section body 4 is turned around the turning shaft 4*a*, the bit attaching section 2 is turned only in one direction together with the operating section body 4 in the following manner. That is, when the operating section body 4 is turned in a direction putting the triangular inclined side of the ratchet 11*a* in contact with the edge of the groove 12, the ratchet member 11 moves into the guide hole 14 against the impetus of the spring 13 as shown in FIG. 5B, and the operating section body 4 can freely rotate in relation to the bit attaching section 2. The bit attaching section 2 does not follow the rotation of the operating section body 4. On the other hand, when the operating section body 4 is turned in a direction putting the vertical side of the ratchet 11*a* in contact with the wall of the groove 12, the ratchet member 11 cannot receive the force necessary for getting in the guide hole 14, the ratchet 11*a* still remaining engaged with the groove 12, and the bit attaching section 2 turns together with the rotation of the operating section body 4. In addition, a cutout section 15 is formed on the side of the operating section body 4 to expose the middle part of the ratchet member 11, and the ratchet member 11 is provided with a control lever 16 which changes the direction of the ratchet 11*a* to a position corresponding to the cutout section 15. Accordingly, the turning direction of the bit attaching section 2 can be changed over together with the operating section body 4 by the control lever 16 according to whether a screw is driven or loosened.

The locking mechanism 6 is now described hereunder. The locking mechanism 6 comprises an operating pin 17 which is disposed on a turning axis with its one end held in the handle section 5 while the other end is held in the operating section body 4, a compression spring 18 serving as an urging means which gives impetus to the handle section 5 in the direction contacting the operating section body 4 through the operating pin 17, and a lock pin 19 which engages the handle section 5 with the operating section body 4, thereby preventing the two sections from being turned together when they contact each other.

As shown in FIG. 2, in the aforementioned operating pin 17, a snap ring 20 is engaged with a groove 17*a* formed on one peripheral end portion thereof. A metallic ring 21, which is turnably mounted on the operating pin 17 and to which a knurling is applied, is pressed into a holding hole 22 concavedly formed in the center portion of the core 5*a* of the handle section 5 so as to be pressed against the snap ring 20. In this manner, the operating pin 17 is held in the handle section 5 so as not to be movable in the axial direction. In addition, the metallic ring 21 is fixedly pressed into the core 5*a* so that one end face thereof is located on the same plane as the core 5*a*.

Further, a pushing ring 23 which pushes up the handle section contacting the metallic ring 21 is fixedly mounted on the middle part of the operating pin 17. The pushing ring 23 can be inserted in the operating pin receiving hole 24 formed on the side end face of the operating section body 4 near the handle section 5. A spring bearing ring 25 which supports slidably the operating pin 17 is fixed to the operating pin receiving hole 24, and the compression spring 18 is disposed between the spring bearing ring 25 and the spring holder 26 provided on one side of the operating pin 17. That is, the operating pin 17 is held in the operating section body 4 so as to be movable in the axial direction. In this manner, the compression spring 18 gives impetus to the operating pin 17 against the bit attaching section 2 side (in the direction indicated by the arrow X in FIG. 2), and, as a result, the handle section 5 is drawn toward the operating section body 4 and comes in contact therewith.

The aforementioned lock pin 19 is fixedly embedded in the surface of the operating section body 4 contacting the handle section 5, and the top end 19*a* of the lock pin 19 projects from the contact surface. An engaging hole 27 is formed in the core 5*a* of the handle section 5, and thus the operating section body 4 can be put in contact with the handle section 5 due to the urging force of the compression spring 18, when the position of the top end 19*a* of the lock pin 19 coincides with that of the engaging hole 27 and they are engaged with each other. That is, the lock pin 19 and the engaging hole 27 form such an engaging means. Accordingly, when the operating section body 4 is in contact with the handle section 5, these two members form an integral one unit by the engagement between the lock pin 19 and the engaging hole 27, and the operating section body 4 is turned together with the handle section 5 when the latter is turned. As a matter of course, another engaging means achieving the same purpose can be constructed by providing the lock pin in the handle section 5 while providing the engaging hole in the operating section body 4.

Figures 6, 7:
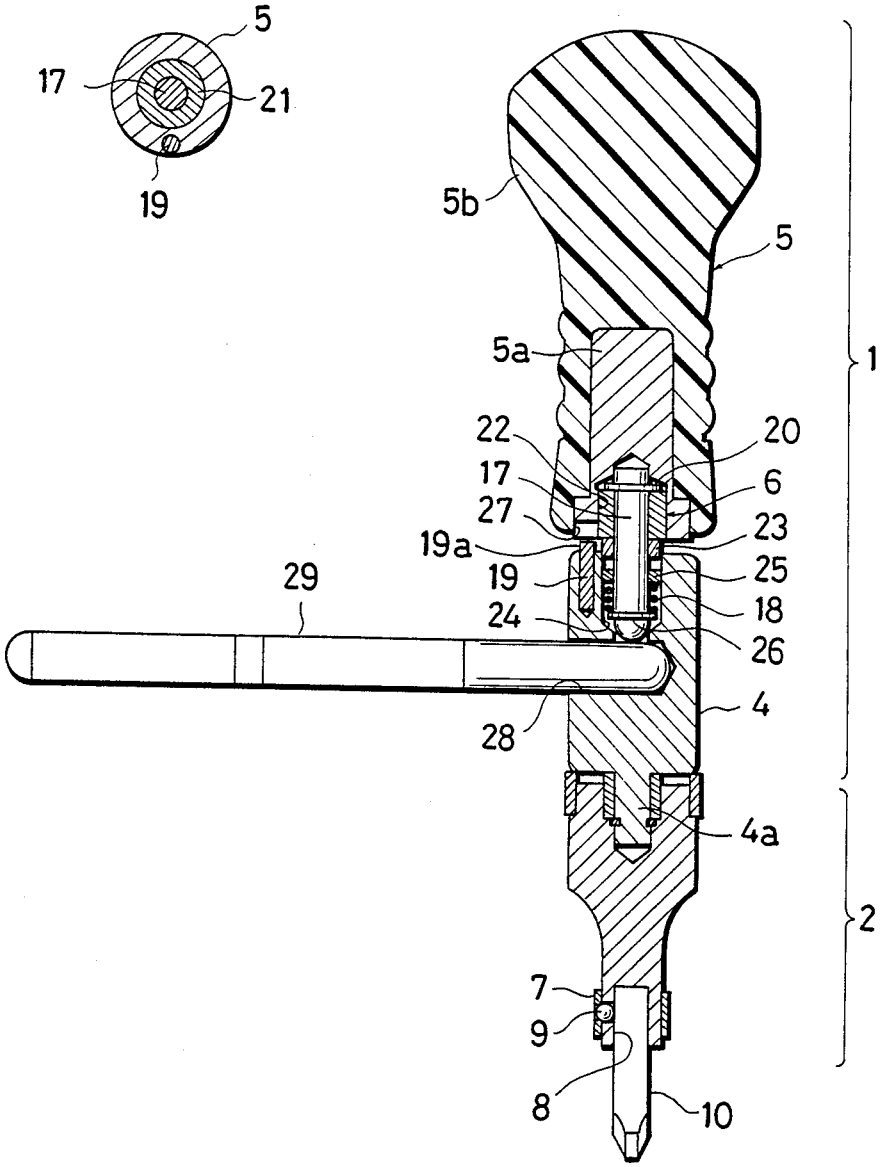
FIG. 6 is a sectional view taken along the line C—C in FIG. 1.
FIG. 7 is a longitudinal sectional view showing the auxiliary handle inserted in the body.

An auxiliary handle receiving hole 28 is formed on the side of the operating section body 4, and when the operating section body 4 is in contact with the handle section 5, the top end of the operating pin 17 projects into the receiving hole 28. The projecting top end of the operating pin 17 is formed hemispherical. Accordingly, when the auxiliary handle 29 is inserted into the receiving hole 28 as shown in FIG. 7, the operating pin 17 is pushed by the auxiliary handle 29 and moves back upwardly from the receiving hole 28 along the spring bearing ring 25 and against the urging force of the compression spring 18, and according to such upward movement, the handle section 5 supporting the operating pin 17 moves separate from the operating section body 4. In this connection, the sliding amount of the operating pin 17 at the time of insertion of the auxiliary handle 29, i.e., the amount of projection of the operating pin 17 projecting into the receiving hole 28 is established larger than that of the top end 19*a* of the lock pin 19 projecting from the operating section body 4. Accordingly, engagement between the lock pin 19 and the engaging hole 27 is released or disengaged by separating the handle section 5 from the operating section body 4 with insertion of the auxiliary handle 29, thus the handle section 5 and the operating section body 4 are freely rotatable in relation to each other.

The ratchet screwdriver of the above construction can be used in the same manner as the conventional ratchet driver by controlling the operating section body 4 and the handle section 5 to turn together. Besides, when it is necessary to carry out driving or loosening with stronger torque, the auxiliary handle 29 is inserted into the receiving hole 28 to make the handle section 5 freely rotatable in relation to the operating section body 4, and the required operation can be performed by controlling the auxiliary handle 29.

Figure 8:
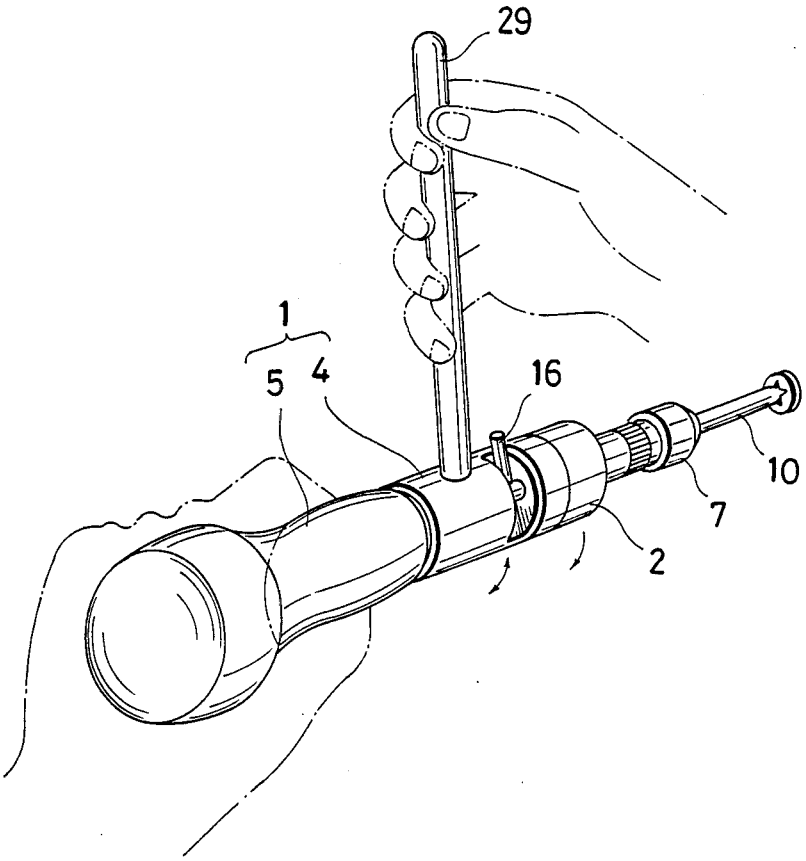
FIG. 8 is a perspective view for explaining how to operate the ratchet screwdriver of the invention.

By such an arrangement, a required strong torque can be obtained by the auxiliary handle 29, which is laterally inserted into the operating section body 4, utilizing lever action. In addition, there is no possibility that the auxiliary handle 29 is removed or gets out accidentally since the auxiliary handle 29 is held between the operating pin 17 and the receiving hole 28 due to the urging force of the compression spring 18. Furthermore, as shown in FIG. 8, the handle section 5 can be held by the remaining hand other than one hand being in charge of operation of the auxiliary handle 29, eventually resulting in a safe and exact operation.

It is also preferable that the ratchet screwdriver according to the present invention has a rocking mechanism by which the lock pin 19 moves in and out of the operating section body 4 according to the movement of the auxiliary handle 29 inward and outward of the operating section body 4. In effect, any arrangement can be adopted so far as the handle section and the operating section body are put in a freely rotatable state to each other by insertion of the auxiliary handle.

What is claimed is:

1. A ratchet screwdriver, comprising:

a bit attaching section;

an operating section body which is connected to said bit attaching section through a ratchet mechanism and capable of turning the bit attaching section around the axis of the bit only in one direction, said operating section body having a contact surface;

a handle section which is movably connected to said operating section body on the turning axis, said handle section having a contact surface;

locking means connecting said operating section body to said handle section, for locking the handle section to the operating section body under a normal state so as to turn the two sections together, the two sections being freely turnable in relation to each other keeping their connected state when said locking means is disengaged; and an auxiliary handle which disengages the locking means, by being inserted from a side of the operating section body thereinto, wherein:

said locking means comprises an operating pin which is disposed on a turning axis with its one end held in the handle section so as to be axially stationary while its other end is held in the operating section body so as to be axially movable, urging means which gives impetus to the handle section so as to contact the operating section body, and engaging means which engages the handle section with the operating section body on their contact surfaces so as not to be rotatable in relation to each other when they are in contact with each other by said urging means;

said handle section moving said operating pin against the impetus of the urging means when an auxiliary handle is inserted into said operating section body, and said handle section being disengaged from the operating section body according to movement of the operating pin; and said auxiliary handle is inserted into an auxiliary handle receiving hole provided laterally on the operating section body so as to push a top end of the operating pin projecting into the auxiliary handle receiving hole and move the operating pin against the impetus of the urging means.

2. A ratchet screwdriver according to claim 1, wherein the top end of the operating pin is hemispherical.

3. A ratchet screwdriver according to claim 1, wherein said urging means comprises a compression spring disposed between a spring holder which is provided on the periphery of one end of the operating pin inserted into said operating section body and a spring bearing ring which is fixed into the operating section body to slidably support the operating pin.

4. A ratchet screwdriver according to claim 1, wherein said ratchet mechanism comprises a plurality of grooves which are provided radially around the turning shaft between the bit attaching section and the operating section body, a ratchet member which is inserted into a sliding guide hole formed in the operating section body, and a compression spring interposed between the bottom of said sliding guide hole and the ratchet member, a top end of said ratchet member being engaged with one of said grooves for turning the bit attaching section together with the operating section body when the operating section body is turned in one direction, while said top end of the ratchet member being disengaged from any of the grooves so that the operating section body turns alone when the operating section body is turned in the reverse direction.

5. A ratchet screwdriver according to claim 3, wherein said ratchet mechanism comprises a plurality of grooves which are provided radially around the turning shaft between the bit attaching section and the operating section body, a ratchet member which is inserted into a sliding guide hole formed in the operating section body, and a compression spring interposed between the bottom of said sliding guide hole and the ratchet member, a top end of said ratchet member being engaged with one of said grooves for turning the bit attaching section together with the operating section body when the operating section body is turned in one direction, while said top end of the ratchet member being disengaged from any of the grooves so that the operating section body turns alone when the operating section body is turned in the reverse direction.

* * * * *